US009731881B2

(12) United States Patent
Barkerding et al.

(10) Patent No.: US 9,731,881 B2
(45) Date of Patent: Aug. 15, 2017

(54) BEVERAGE CARRIER WITH DETACHABLE SLEEVES AND METHOD FOR MAKING THE SAME

(71) Applicant: SmartPak, LLC, Metairie, LA (US)

(72) Inventors: T. Pike Barkerding, New Orleans, LA (US); Robert Henry Post, Covington, LA (US)

(73) Assignee: SmartPak, LLC, Metairie, LA (US)

( * ) Notice: Subject to any disclaimer, the term of this patent is extended or adjusted under 35 U.S.C. 154(b) by 0 days.

(21) Appl. No.: 15/062,925

(22) Filed: Mar. 7, 2016

(65) Prior Publication Data

US 2016/0185499 A1 Jun. 30, 2016

Related U.S. Application Data

(62) Division of application No. 14/583,387, filed on Dec. 26, 2014, now Pat. No. 9,327,889.

(Continued)

(51) Int. Cl.

| | |
|---|---|
| ***B65D 71/48*** | (2006.01) |
| ***B31B 3/00*** | (2006.01) |
| ***B65D 71/40*** | (2006.01) |
| ***B65D 71/12*** | (2006.01) |
| ***B65D 81/38*** | (2006.01) |

(Continued)

(52) U.S. Cl.

CPC ..... *B65D 71/48* (2013.01); *B31B 3/00* (2013.01); *B31B 3/26* (2013.01); *B31B 3/60* (2013.01); *B31B 17/00* (2013.01); *B65D 71/125* (2013.01); *B65D 71/406* (2013.01); *B65D 81/3876* (2013.01); *B31B 2203/103* (2013.01); *B31B 2217/10* (2013.01); *B65B 3/00* (2013.01); *B65D 2571/0066* (2013.01);

(Continued)

(58) Field of Classification Search

CPC ..... B65D 71/12; B65D 71/125; B65D 71/40; B65D 71/406; B65D 71/44; B65D 71/52; B65D 81/376; B65D 81/3876; B65D 2571/0014; B65D 2571/00141; B65D 2571/00475; B65D 2571/0066; B65D 2571/00802; B65D 71/08; B65D 71/48; B65D 75/56; B31B 3/00; B65B 3/00

USPC ..... 206/141, 143, 144, 150, 151, 200, 427

See application file for complete search history.

(56) References Cited

U.S. PATENT DOCUMENTS 2,693,298 A * 11/1954 Palmer ..... B65D 71/0077 206/200
3,734,278 A * 5/1973 Kerrigan ..... B65D 75/56 206/144
5,437,364 A * 8/1995 Broskow ..... B65D 71/504 206/143

FOREIGN PATENT DOCUMENTS

DE 19733672 A1 2/1999
KR 10-2013-0048030 * 9/2013 ..... B65D 71/44

OTHER PUBLICATIONS

Appl. No. PCT/US14/72440, EPO European Search Report, dated Apr. 19, 2017.
Appl. No. PCT/US14/72440 filed Dec. 26, 2014, Barkerding.

* cited by examiner

*Primary Examiner* — Bryon Gehman
(74) *Attorney, Agent, or Firm* — AdamsIP, LLC; J. Hunter Adams; Stephen Thompson

(57) ABSTRACT

The present invention provides a beverage carrier for holding, storing, and carrying one or more beverages. Advanta- (Continued)

geously, the carrier comprises detachable sleeves that each hold a beverage container. When a sleeve is detached from the remainder of the beverage carrier, with the beverage remaining within the sleeve, the sleeve serves as an insulating device to reduce the transfer of heat to or from the beverage during consumption.

19 Claims, 8 Drawing Sheets

Related U.S. Application Data

(60) Provisional application No. 61/921,404, filed on Dec. 27, 2013.

(51) Int. Cl.

| | |
|---|---|
| ***B31B 17/00*** | (2006.01) |
| ***B31B 3/26*** | (2006.01) |
| ***B31B 3/60*** | (2006.01) |
| *B65B 3/00* | (2006.01) |

(52) U.S. Cl.

CPC ..... *B65D 2571/00141* (2013.01); *B65D 2571/00475* (2013.01); *B65D 2571/00802* (2013.01)

BEVERAGE CARRIER WITH DETACHABLE SLEEVES AND METHOD FOR MAKING THE SAME

CROSS REFERENCES

The present application is a divisional of prior U.S. application Ser. No. 14/583,387, filed on Dec. 26, 2014, currently pending, which claims the benefit of U.S. Provisional Application No. 61/921,404, filed on Dec. 27, 2013, which applications are incorporated herein by reference.

BACKGROUND OF THE INVENTION

I. Field of the Invention

The present invention relates to beverage carriers, and more specifically to beverage carriers comprising detachable insulating sleeves and the method of making said beverage carriers.

II. Description of Related Art

Beverage carriers are used, generally, to hold and transport one or more beverage containers. Commonly, beverage carriers are used to hold six individual glass bottles (i.e., a sixpack) so that they can be stored and transported easily. These six-pack carriers are generally made of cardboard or paperboard, and are assembled using automated systems capable of cutting, folding and gluing the beverage carriers.

When a user desires to open and drink the beverages contained within the carrier, the user generally lifts the beverages out of the carrier and subsequently discards the carrier once all individual beverages are removed. The user may then desire to keep his or her beverage insulated from external heat sources, such as heat from the environment or heat from the user's hand, during consumption by inserting the beverage into an insulating device (for example, a Koozie®, huggie, can coolers, etc.). However, the user may often find himself or herself without a can cooler, and, thus, unable to easily insulate his or her beverage.

A beverage carrier that comprises sleeves that retain their structure after detachment from the carrier, that serve to insulate the beverage from external heat sources such as heat from the environment or heat from the user's hand during consumption (and, thus, eliminating the need to utilize a separate koozie), and that further can be simply assembled using automated machinery and materials commonly used in the industry, is clearly needed.

BRIEF SUMMARY OF THE INVENTION

One aspect of the present invention provides for a beverage carrier for carrying one or more individual beverage containers. The beverage carrier comprises a handle having one or more windows disposed within the handle, and one or more individual sleeves wherein each of the one or more sleeves comprises an attachment skirt. When the sleeves are attached to the handle, each of the respective attachment skirts rests within a respective one of the one or more windows. The user can remove a sleeve containing a beverage container simply by lifting the sleeve away from the handle such that the skirt is lifted out of the window. Each sleeve remains structurally intact after detachment.

When carrying one or more beverages, each sleeve surrounds one beverage container. Thus, a user of the device can detach a sleeve containing a beverage container, such as a bottle or can filled with a beverage, and drink the beverage with the sleeve surrounding the beverage container. The sleeve insulates the beverage from external heat sources, such as heat from the environment or heat from the user's hand. Conversely, the sleeve also protects the user's hand from becoming too cold when holding a cold beverage container. Additionally, although the device is typically used to insulate cold beverages, it may also be used in the same manner to insulate hot beverages.

Another aspect of the present invention provides a method of assembling a beverage carrier. The carrier is preferably assembled from a handle template and one or more individual sleeve templates. The handle template has one or more windows disposed within the template. The handle template is folded in half to form a handle having a first side and a second side. In a preferred embodiment, the handle has two or more windows on each side of the handle. Each of the one or more sleeve templates has an attachment skirt and two opposing ends. The opposing ends are then attached to each other to form a three-dimensional sleeve having an attachment skirt. The sleeve is attached to the handle by inserting the attachment skirt into a respective one of the windows in the handle.

Accordingly, one object of the present invention is to provide a beverage carrier comprising sleeves that retain their structure after detachment from the carrier.

Another object of the present invention is to provide a beverage carrier with detachable sleeves that serve to insulate the beverage from external heat sources such as heat from the environment.

Yet another object of the present invention is to provide a method of making a beverage carrier that can be assembled using automated machinery and materials commonly used in the industry.

BRIEF DESCRIPTION OF THE DRAWINGS

These and other features, aspects, and advantages of the present invention will become better understood with regard to the following description, appended claims, and accompanying drawings where:

DETAILED DESCRIPTION

Detailed descriptions of one or more preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in any appropriate manner.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The present invention provides for a carrier for holding one or more containers wherein said containers are each separately enclosed by a sleeve, and each sleeve can be individually removed from the remainder of the carrier. When each sleeve is removed from the remainder of the carrier, each sleeve retains its shape. In one use of the present invention, the carrier holds a six pack of bottled beverages, such as beer or soda. Another feature of the present invention is that each of the sleeves serves to insulate the bottle contained therein, both while the sleeves are attached to the carrier and after they have been removed from the remainder of the carrier. Because of the removable insulated sleeves, the user does not have to use an additional insulating device, wherein said insulating devices are also referred to as koozies, huggies, can coolers, etc. Moreover, the carrier of the present invention can be formed from a variety of materials, including, but not limited to, paperboard, cardboard, chipboard, posterboard, polystyrene foam, fabric, balsa wood, corrugated cardboard, corrugated plastic, plastic sheeting, neoprene, foam rubber, any combination of the foregoing, and other similar materials known in the art.

One embodiment of the beverage carrier 10 of the present invention is depicted in FIGS. 1-7. We speculate that this embodiment of the carrier 10 of the present invention utilizes less material and glue than the average beverage carrier already in the marketplace, and that it can be assembled using automated machinery or by hand. Additionally, we speculate that the construction of the carrier 10 of this embodiment of the present invention requires fewer steps than the method of constructing the average beverage carrier already in the marketplace.

Figure 1:
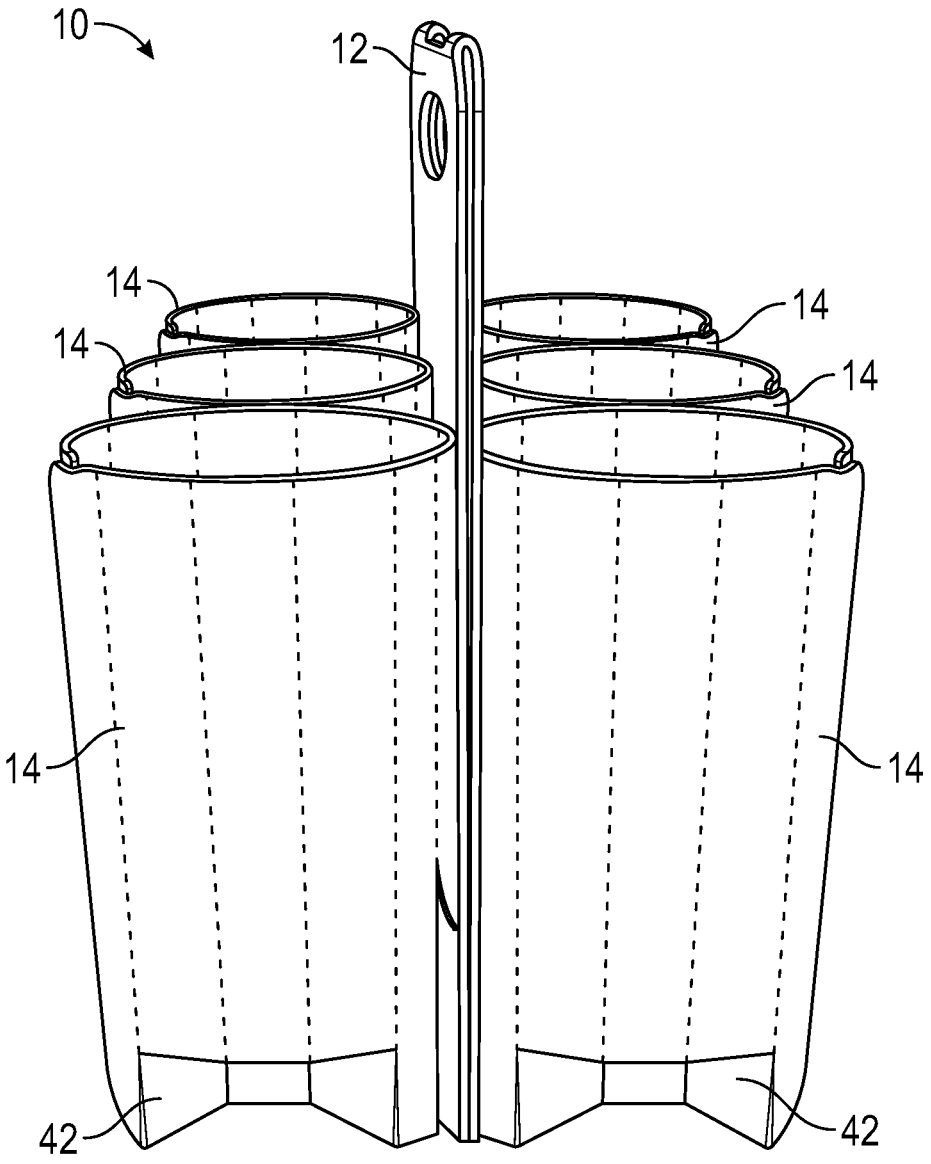
FIG. 1 shows a perspective view of a beverage carrier embodying features of the present invention.
Figure 2:
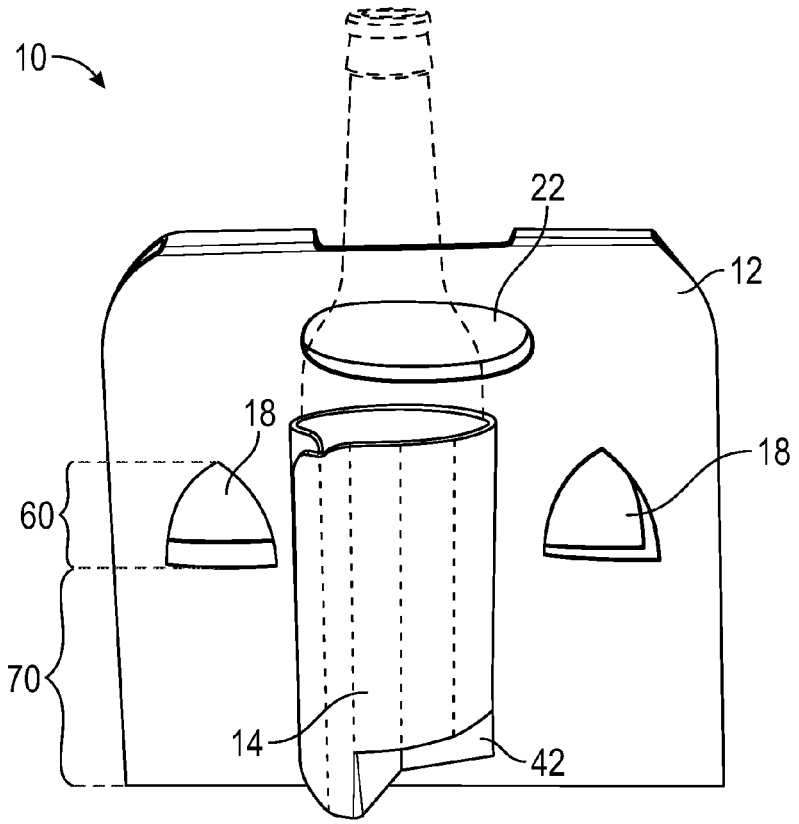
FIG. 2 shows a side perspective view of a beverage carrier embodying features of the present invention.
Figure 3:
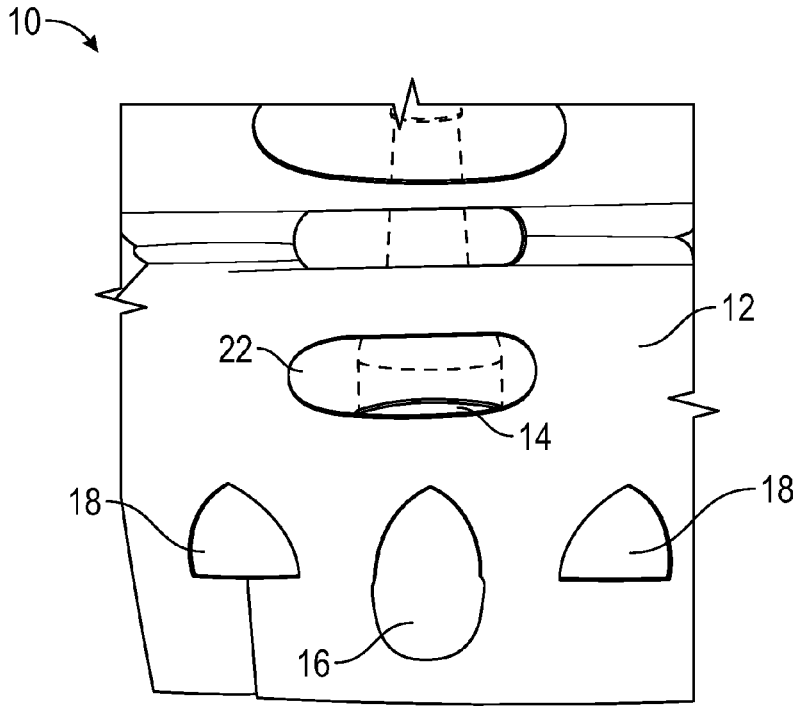
FIG. 3 shows an interior view of a beverage carrier embodying features of the present invention.

As can be seen in FIG. 1, this embodiment comprises six sleeves 14 positioned in two parallel rows. Three sleeves 14 are attached to one side of a handle 12 and three sleeves 14 are attached to the opposite side of the handle 12. The sleeves 14 are detachable from the beverage carrier 10 using a lift-out design. As shown in FIGS. 2-3, the handle 12 comprises six identical attachment windows 18. Each individual sleeve 14 has an attachment skirt 16 that rests within a respective attachment window 18. Each sleeve 14 can be individually detached from the carrier 10 by lifting the sleeve 14 upward so that the attachment skirt 16 is removed from the respective attachment window 18 in which the skirt 16 rests.

Figure 5:
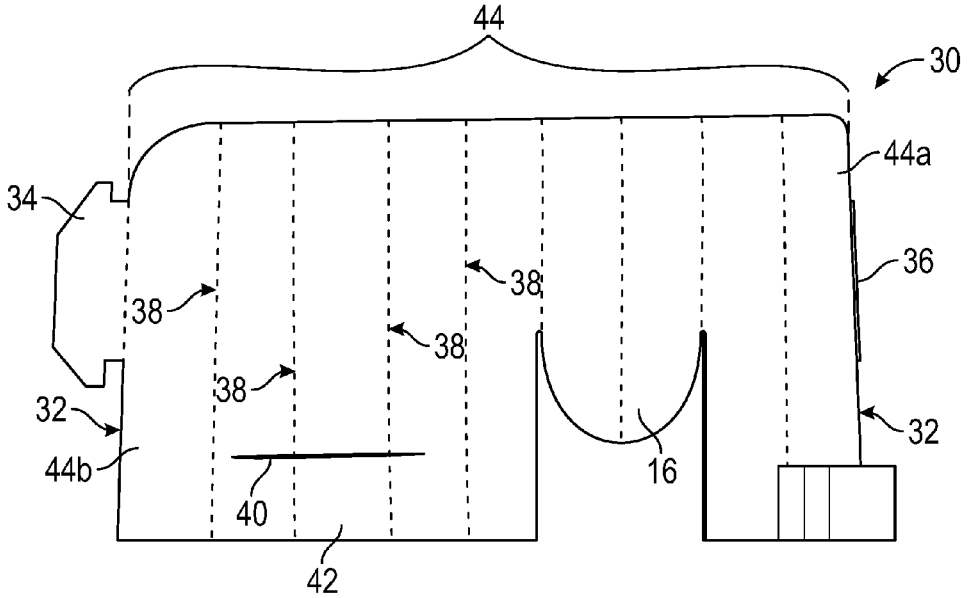
FIG. 5 shows an elevational view of a template to create a handle of a beverage carrier embodying features of the present invention.
Figure 6:
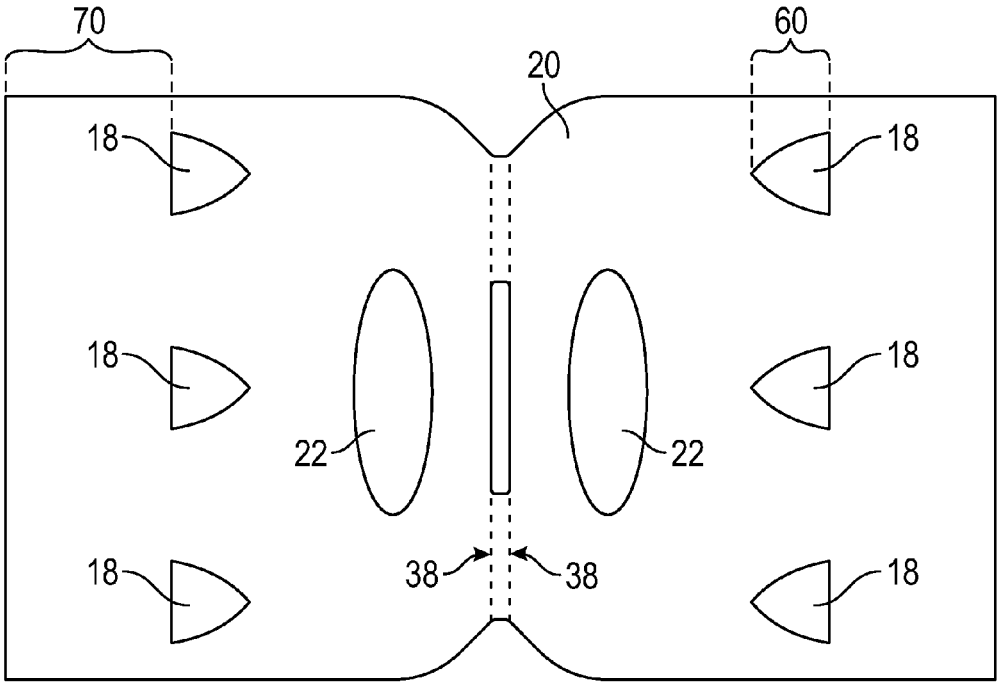
FIG. 6 shows an elevational view of a template to create a sleeve of a beverage carrier embodying features of the present invention.

In a preferred embodiment, the carrier 10 is assembled from a handle template 20 and one or more sleeve templates 30. Each of the one or more sleeve templates 30 is used to form one individual sleeve 14 for attachment to the handle 12. FIGS. 5 and 6 illustrate preferred embodiments of a handle template 20 and a sleeve template 30, respectively.

The handle template 20 shown in FIG. 6 is utilized to make a beverage carrier 10 for carrying six individual beverage containers. The handle template 20 has three windows 18 on each side of the handle template 20. The handle template 20 is folded in half to form the handle 12 of the beverage carrier 10. After folding the template 20, the three windows 18 on one side of the template 20 preferably align with the three windows 18 on the opposite side of the template 20, as shown in FIG. 2, such that the six pack carrier 10 is symmetric. In a preferred embodiment, two folds 38 are made where the template 20 is folded in half so that the template 20 is easier to fold during assembly. In another preferred embodiment, the handle template 20 also has two handle openings 22. After folding the template, the handle openings 22 align such that a user can carry the beverage carrier 10 by grabbing onto the handle 12 through the aligned openings 22.

FIG. 5 illustrates one of the sleeve templates 30 used in assembling the beverage carrier 10. In the embodiment shown in FIGS. 1-3, six separate sleeve templates 30 are utilized to form six individual sleeves 14 for attachment to the handle 12. Each sleeve 14 has a generally cylindrical shape and is used to hold a single beverage container. Each sleeve template 30 has two opposing ends 32. The generally cylindrical shape of each sleeve 14 is formed by bending the sleeve template 30 such that the opposing ends 32 contact each other and by then attaching the opposing ends 32 to each other. In a preferred embodiment, as shown in FIG. 5, the sleeve template 30 has a tab 34 at one end and a slot 36 at the opposite end. In this embodiment, the opposing ends 32 are attached by inserting the tab 34 of each sleeve 14 into the respective slot 36.

Before each sleeve 14 is formed into a generally cylindrical shape, each sleeve template 30 may be folded at intervals along one or more latitudinal lines to create two or more sleeve panels 44 for each sleeve template 30. The locations of exemplary folds 38 in the sleeve template 30 are shown in FIG. 5 by dotted lines. In this embodiment, folds 38 are made at approximately one-inch intervals along the length of the sleeve template 30 to create nine sleeve panels 44 in each sleeve template 30. However, a greater or lesser number of folds 38 may be included to create more or fewer sleeve panels 44. The folding of the sleeve template 30 to create sleeve panels 44 allows the material making up the sleeve template 30 to more easily bend into a generally cylindrical shape. Additionally, the folding of the sleeve template 30 allows for each sleeve 14 to be compressed flat after a beverage container has been removed from the sleeve 14, and thus allows for easy storage or disposal of the sleeve 14.

After folds 38 are made to form panels 44, each sleeve template 30 has two end panels, 44*a* and 44*b*, adjacent to each end 32, respectively. As an alternative to attaching the opposing ends 32 using a tab 34 and slot 36, the opposing ends 32 may also be attached to each other by applying an adhesive or glue to one or both of the end panels 44*a*, 44*b* and gluing the end panels 44*a*, 44*b* together. It should be understood that any suitable means for securing the ends 32 of each sleeve template 30 to each other may be utilized, including, but not limited to, structured board (i.e., one-way insertion methods), hinges, tacks, staples, zippers, hook and loop tape (e.g., "Velcro"), sewn thread, springs, clips, buckles, hooks, magnets, nails, screws, suction, or any similar attachment means know in the art.

Figure 4:
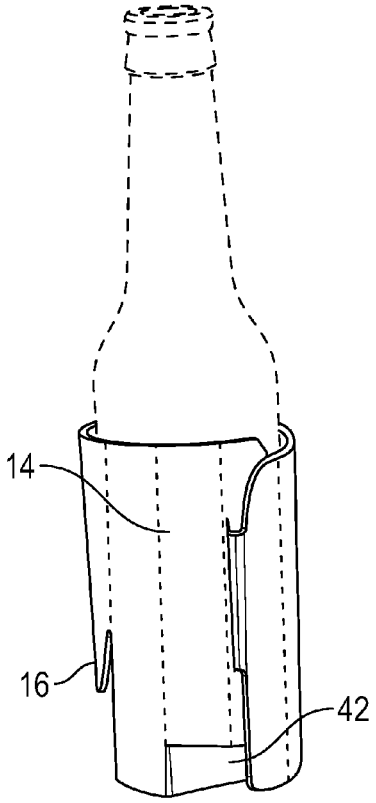
FIG. 4 shows a view of a detached sleeve of a beverage carrier embodying features of the present invention.

Each sleeve template 30 further comprises an attachment skirt 16. Once each sleeve template 30 has been formed into an individual sleeve 14, the sleeve 14 can be attached to the handle 12 by placing the attachment skirt 16 into a respective one of the attachment windows 18 of the handle 12, as shown in FIG. 3. One sleeve 14 is attached to each respective attachment window 18 to complete the assembly of the beverage carrier 10. Each respective attachment skirt 16 rests within a respective attachment window 18 such that a user can carry the beverage carrier 10 by the handle 12 in an upright position without the individual sleeves 14 detaching from the carrier 10. To detach each individual sleeve 14 from the assembled beverage carrier 10, the user simply lifts the desired sleeve 14 upwards and the attachment skirt 16 is removed from the handle 12. FIG. 4 illustrates a sleeve 14 that has been detached from the beverage carrier 10 while holding a beverage container.

As shown in FIGS. 2 and 6, each attachment window 18 has a diameter 60. The diameter 60 of each window 18 may be varied in order to accommodate beverage containers of various weights and sizes. For instance, it may be preferable to have larger windows 18 when utilizing the carrier 10 for carrying standard 12-ounce bottle containers as opposed to 12-ounce cans due to the additional weight of bottles as compared to cans. In another embodiment, the carrier 10 may be utilized to carry larger bottles, such as 750 milliliter wine bottles, which may require larger windows 18 to support the weight of wine bottles. In a preferred embodiment, each attachment window 18 preferably has a generally triangular shape, but may alternatively be of another shape, such as a rectangle or square. In the embodiment shown in FIGS. 2-3 being utilized for carrying 12-ounce bottled beverages, the generally triangular attachment windows 18 are preferably about 1.625 inches in height with a base length of approximately 2.25 inches. These dimensions may be varied according to manufacturing and customer considerations.

Figure 7:
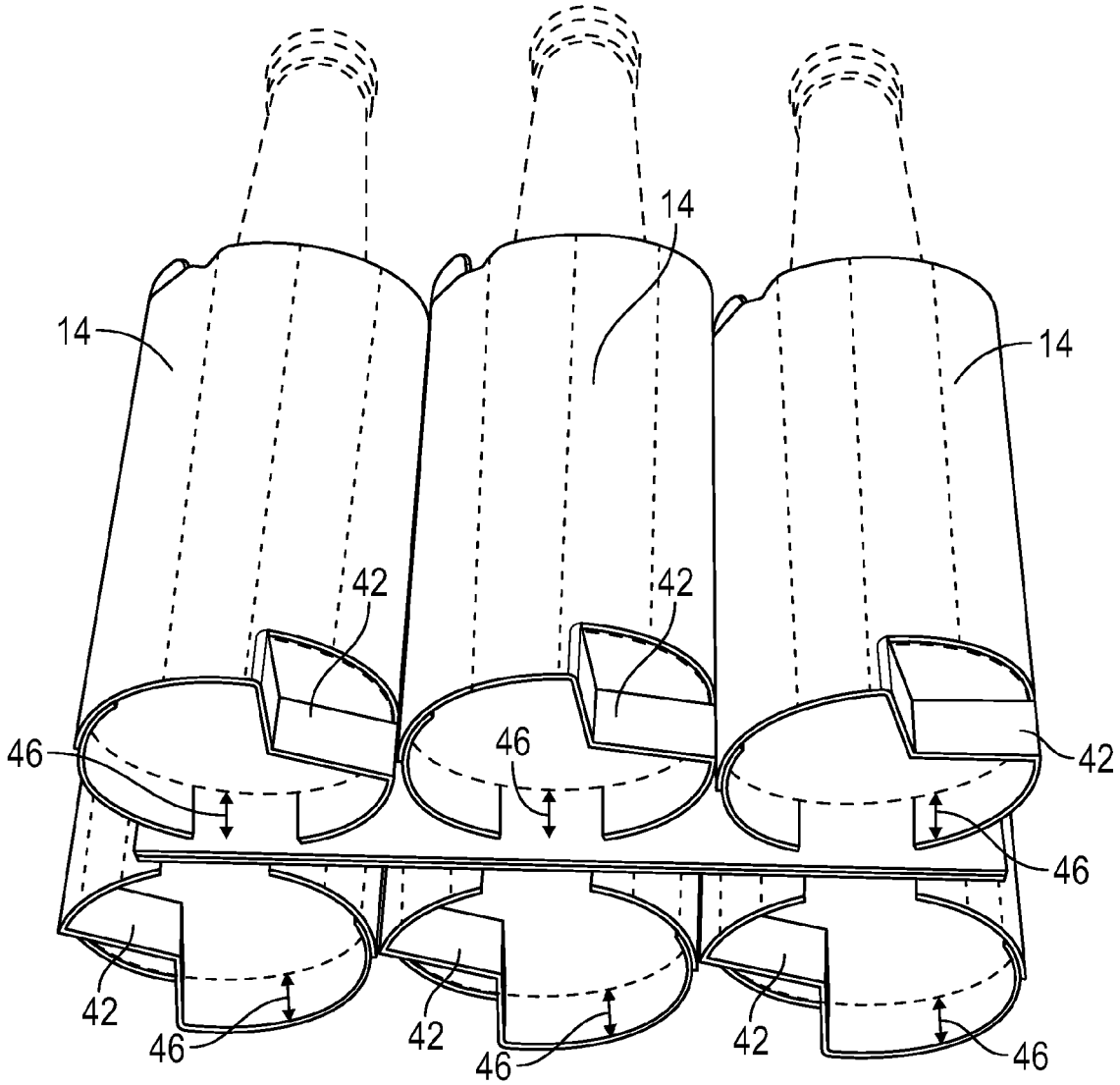
FIG. 7 shows a bottom perspective view of a beverage carrier with bottles inserted into the sleeves.
Figure 9:
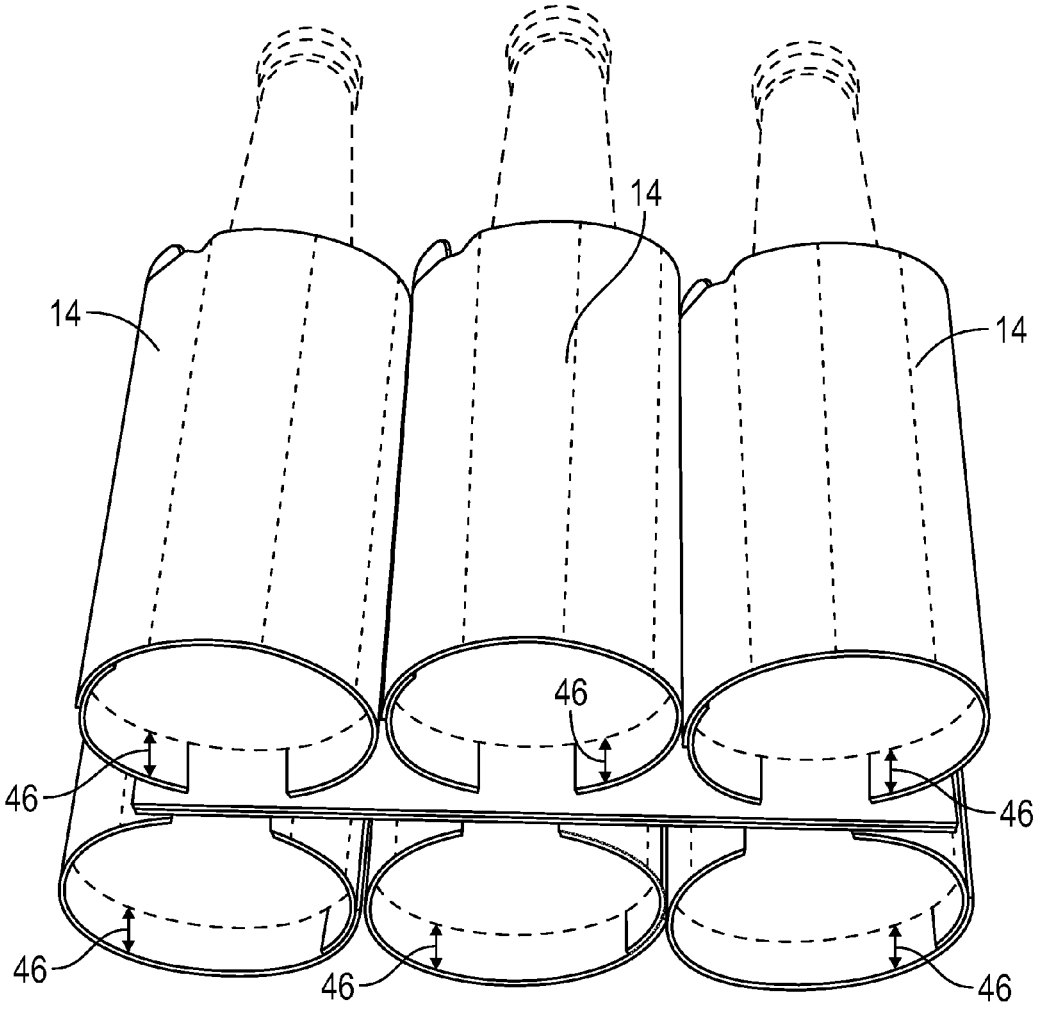
FIG. 9 shows a perspective view of a beverage carrier with bottles inserted into the sleeve.

As shown in FIGS. 2 and 6, the handle template 20 comprises a bottom portion 70 on each side of the template 20. The bottom portion 70 extends from the bottoms of the attachment windows 18 to the bottom of the handle 12 when the handle 12 is in an upright position for carrying beverages. In a preferred embodiment, as best seen in FIGS. 7 and 9, the bottom portion 70 is sized such that the bottom of the handle 12 is approximately even with the bottom ends of each of the sleeves 14 when holding beverage containers as designed for a specific embodiment of the carrier 10. This configuration of the handle 12 provides the carrier 10 with added stability as individual sleeves 14 are removed from the carrier 10 when the carrier 10 is in an upright position resting on a generally flat surface. The length of the bottom portion 70 may be varied to accommodate beverage containers of various weights and sizes such that the bottom of the handle 12 is approximately even with the bottom ends of each of the sleeves 14.

In a preferred embodiment, as shown in FIG. 5, the sleeve template 30 further comprises a support cut 40 and a support segment 42. The support cut 40 of the present invention is approximately 1.5 inches long, but may be longer or shorter. Also, the support cut 40 is made approximately 0.5 inches from the bottom of the sleeve template 30, but may be closer or further from the bottom. As best seen in FIG. 2, the previously created support cut 40 of each of the sleeves 14 allows the support segment 42 to be pushed inwards towards the center of the generally cylindrical sleeve 14 during assembly. Thus, the inwardly pushed support segment 42 supports the bottom of the beverage container and prevents the container from sliding all the way through the sleeve 14. As shown in FIG. 7, the support segment 42 forms a lower void 46 between the bottom of each sleeve 14 and the bottom of each respective beverage container. The lower void 46 provides added protection to the beverage containers contained within the beverage carrier 10. The lower void 46 aids in preventing glass containers from breaking if the beverage carrier 10 is dropped by the user.

The handle 12 and the sleeves 14 of the beverage carrier 10 may be cut from a blank, or, in other words, a single piece of paperboard or other material, as shown in FIGS. 5 and 6. For example, a unitary piece of 18 point or 24 point AquaKote® (Wet Strength CCK) paperboard may be used as the blank. In FIGS. 5-6, the solid lines indicate cuts that are to be made to the blank to create the specific shape of the handle and sleeve templates 20, 30. The dotted lines in FIG. 5-6 indicate folds 38 that are made to the blank. Each template 20, 30 is a substantially flat, unitary piece of material.

The handle and sleeve templates 20, 30 can be cut and assembled by manual or by automated means already known in the art. The following describes one method of creating a beverage carrier 10 using automated means. In the following description, the blank is referred to as having a top side and a bottom side wherein the top side faces upwards and the bottom side faces downwards during assembly. Referring to FIGS. 5-6, which depict an aerial view looking downward on the top side of exemplary blanks, the blanks may be cut using an automated die cutter, such as a BOBST® Flatbed Die-Cutter. The die cutter, using the schematic that is uploaded to the die cutter (where FIGS. 5 and 6 are exemplary schematics of a handle 12 and a sleeve 14, respectively), makes cuts corresponding to the solid lines. The die cutter first makes cuts to form the exterior shape of each template 20, 30. The die cutter also makes cut to the handle template 20 to form the handle openings 22 and the attachment windows 18. In addition, the die cutter makes a cut to the sleeve template 30 at the location of the support cut 40 to form the support segment 42.

After the cuts are made by the die cutter, the handle and sleeve templates 20, 30 may be assembled into a beverage carrier 10 by a folder-gluer line (such as a BOBST® Folder Gluer). The folder-gluer line, using the schematic that is uploaded to the folder-gluer line, first makes folds 38 (also known as scores) to the handle and sleeve templates 20, 30 corresponding to the dotted lines of the schematic. The folder-gluer line may apply glue to the sleeve template 30 in the appropriate locations for attaching the ends 32 of the sleeve template 30 to each other, if necessary, depending on the particular embodiment of the carrier 10 and method of assembly.

To form the handle 12 of the carrier 10, the handle template 20 is folded in half by folding the handle template 20 downward such that the handle openings 22 and the attachment windows 18 are aligned.

Next, the ends 32 of the sleeve template 30 are attached to each other to form a generally cylindrical sleeve 14. The ends 32 the sleeve template 30 are attached by bending the template 30 either upward or downward. The folder-gluer line may be used to apply glue to either side of one or both of the end panels 44*a*, 44*b* to attach the ends 32 of the template 30 to each other. Alternatively, the tab 34 may be inserted into the slot 36 to complete the attachment of the ends 32 and form a generally cylindrical sleeve 14. The support segment 42 is then pushed inward toward the center of the sleeve 14 to form a bottom support for a beverage container.

Finally, the attachment skirt 16 of each respective sleeve 14 is inserted into a respective one of the attachment windows 18 of the handle 12 to complete the assembly of the beverage carrier 10.

The sleeves 14 shown in FIGS. 1 and 6 are approximately five inches tall. However, the sleeves 14 can be taller or shorter depending on manufacturer and/or customer preferences.

Figure 8:
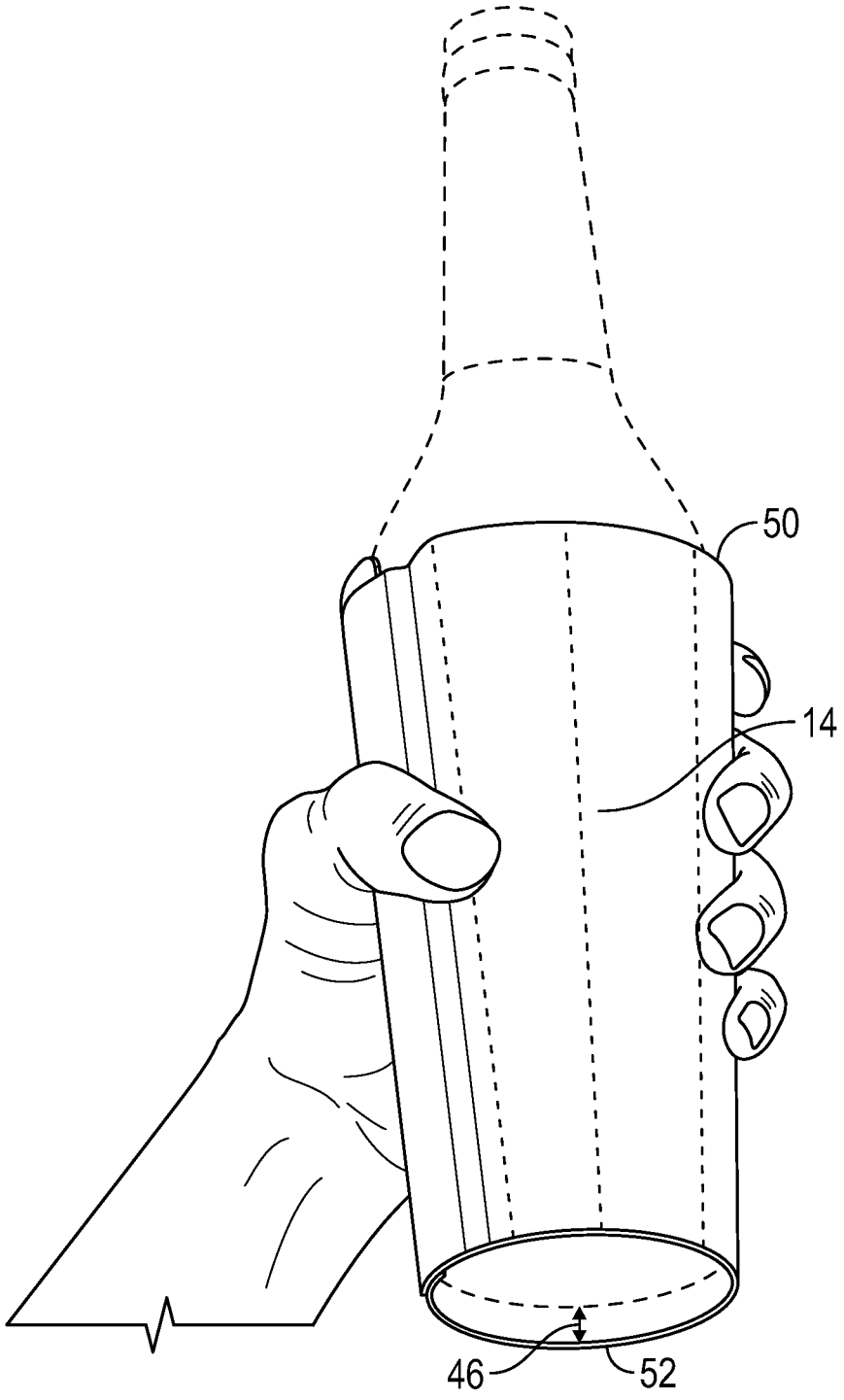
FIG. 8 shows a view of a detached sleeve of a beverage carrier embodying features of the present invention.

In an alternative embodiment, each sleeve 14 may have an upper diameter 50 that is larger than a lower diameter 52, as shown in FIG. 8. In a preferred version of this embodiment, the upper diameter 50 is approximately 2.5 inches and the lower diameter 52 is approximately 2.125 inches when the sleeve 14 is expanded to its largest diameter, for instance, when the sleeve is surrounding a beverage container. These dimensions allow a standard twelve ounce glass beer bottle to be slipped into the top of the sleeve 14 but will not allow the bottle to pass all the way through. In other words, the tapered design of the sleeve 14 secures the container within the sleeve 14 without requiring a support segment 42, though the support segment 42 may optionally be used in addition to the tapered design of this embodiment. As shown in FIG. 9, the tapered design forms a lower void 46 between the bottom of each sleeve 14 and the bottom of each respective beverage container that will prevent the beverage container from sliding through the sleeve 14. In the embodiment utilizing the sleeve diameters 50, 52 recited above without using a support segment 42, the lower void 46 is approximately 0.3125 inches long. The upper and lower sleeve diameters 50, 52 may be smaller or larger to accommodate various sized containers.

After assembly, beverage containers can be placed into the sleeves 14 either manually or by automated means. FIGS. 2, 4, and 7-9 depict the assembled beverage carrier 10 with bottles inserted into the sleeves 14. The lift-out design of the handle 12 and sleeves 14 allows for a user to easily detach the sleeves 14 from the beverage carrier 10 by lifting the sleeve (or by lifting the bottle contained within the sleeve) upward and away from the beverage carrier 10. As shown in FIG. 4, after detaching the sleeved container from the remainder of the beverage carrier 10, the sleeves 14 remain structurally intact. In other words, after detaching a sleeved container, the user can then allow the sleeve 14 to remain on the beverage container and use the sleeve 14 as an insulating device for the container to reduce the transfer of heat from external heat sources, such as heat from the environment or heat from the user's hand, to the container during use. Conversely, the sleeve 14 also protects the user's hand from becoming too cold when holding a cold beverage container. Additionally, although the device is typically used to insulate cold beverages, it may also be used in the same manner to insulate hot beverages.

Figure 10:
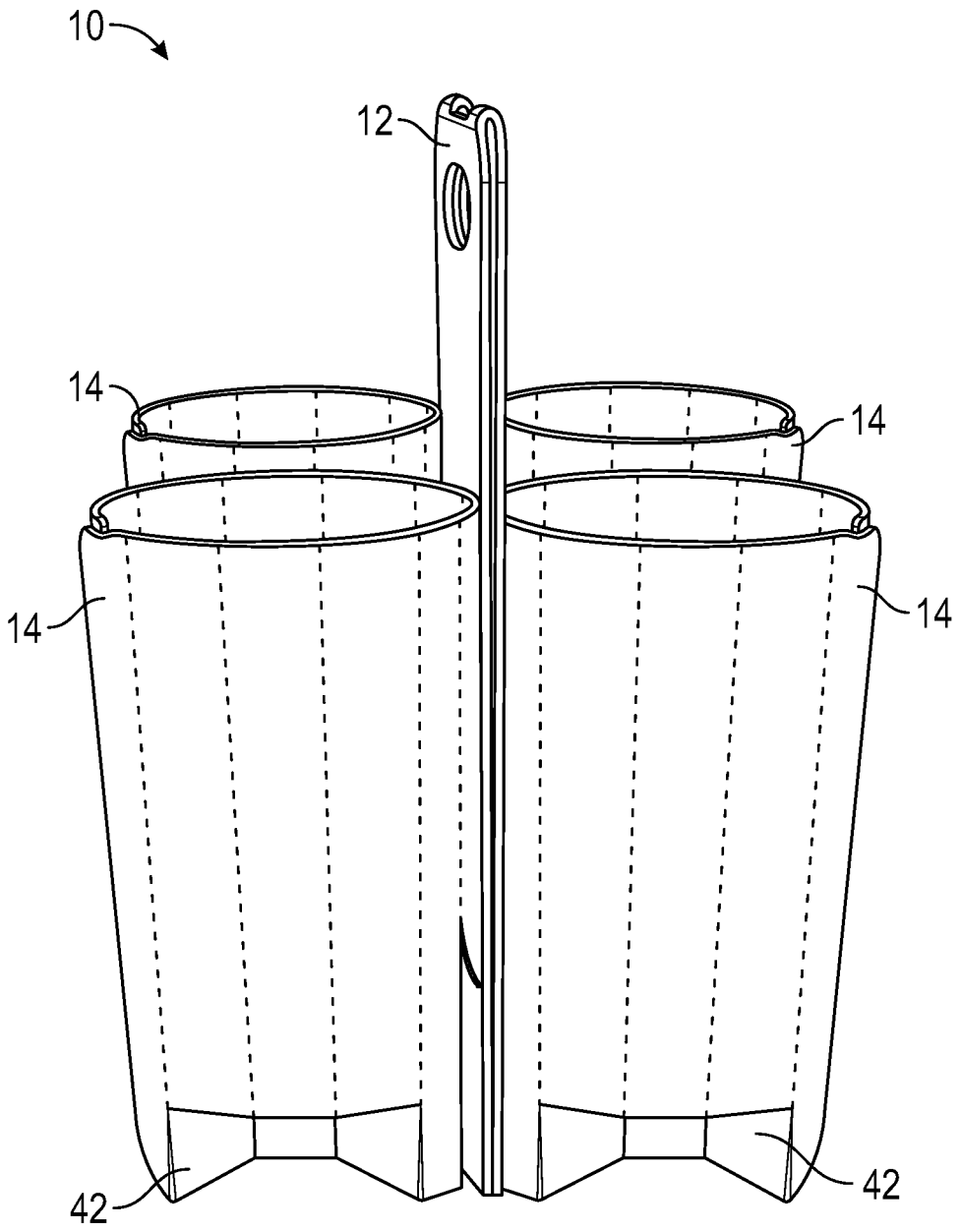
FIG. 10 shows a perspective view of a beverage carrier having four sleeves.

FIGS. 1-3 depict a beverage carrier 10 comprising six sleeves. However, the beverage carrier 10 of the present invention may comprise any number of sleeves, including, but not limited to, two sleeves or four sleeves. For example, FIG. 10 shows an alternate embodiment wherein the beverage container 10 comprises four sleeves 14. In this embodiment, the handle 12 has two attachment windows 18 on each side of the handle 12. In yet another alternative embodiment, the handle 12 may have an alternative three-dimensional shape such as a circular or square shape (instead of a flat shape), and the sleeves 14 may be attached to the perimeter of the three-dimensional handle.

In an exemplary embodiment, the handle may be made of a different material from that used to form the individual sleeves. For example, the handle may be made of cardboard, while the individual sleeves are made of a different material, such as, but not limited to, foam rubber or neoprene.

It is understood that versions of the invention may come in different forms and embodiments. Additionally, it is understood that one of skill in the art would appreciate these various forms and embodiments as falling within the scope of the invention as disclosed herein.

What is claimed is:

1. A beverage carrier for carrying one or more beverage containers, said carrier comprising:

a. a handle having one or more windows disposed within the handle; and b. one or more sleeves, wherein each of said one or more sleeves comprises an attachment skirt, and wherein each respective attachment skirt rests within only one of said one or more windows.

2. The beverage carrier of claim 1, wherein one or more beverage containers is located within each of said one or more sleeves, respectively, wherein each of said one or more sleeves comprises a top end and a bottom end, and wherein a lower void exists between a bottom of each of said one or more beverage containers and said bottom end of each of said one or more sleeves.

3. The beverage carrier of claim 2, wherein each of said one or more sleeves further comprises a support segment for supporting a beverage container.

4. The beverage carrier of claim 1, wherein each of said one or more sleeves comprises a top end and a bottom end, wherein an upper diameter of said top end is greater than a lower diameter of said bottom end.

5. The beverage carrier of claim 4, wherein one or more beverage containers is located within each of said one or more sleeves, respectively, wherein a lower void exists between a bottom of each of said one or more beverage containers and said bottom end of each of said one or more sleeves.

6. The beverage carrier of claim 4, wherein each of said one or more sleeves further comprises a support segment for supporting a beverage container.

7. The beverage carrier of claim 1, wherein said beverage carrier comprises four or more sleeves.

8. The beverage carrier of claim 7, wherein said handle comprises a first side and a second side, wherein said four or more sleeves are arranged in a first row and a second row, where said first row is disposed along a length of said first side of said handle and said second row is disposed along a length of said second side of said handle.

9. A method of assembling a beverage carrier, said method comprising the steps:

a. providing a handle having one or more windows disposed within the handle;

b. providing one or more sleeves, wherein each of said one or more sleeves comprises an attachment skirt; and c. inserting the attachment skirt of each of said one or more sleeves into a respective one of said one or more windows such that each respective attachment skirt rests within only one of said one or more windows.

10. The method of claim 9, wherein the handle is formed by folding a substantially flat handle template in half.

11. The method of claim 10, wherein the handle template has two handle openings configured such that the handle openings align with each other after folding the handle template.

12. The method of claim 9, wherein each of said one or more sleeves is formed from a substantially flat sleeve template.

13. The method of claim 12, wherein the sleeve template has two opposing ends, and wherein each of the one or more sleeves is formed by bending the sleeve template such that the opposing ends contact each other and attaching the opposing ends to each other.

14. The method of claim 13, wherein the opposing ends of the sleeve template are attached to each other by inserting a tab located at one end into a slot located at the opposite end.

15. The method of claim 13, wherein the opposing ends of the sleeve template are attached to each other by adhesive applied to at least one of said opposing ends.

16. The method of claim 13, further comprising the steps of cutting a support cut in the sleeve template to create a support segment for each of the one or more sleeves and, after the step of forming each of the one or more sleeves, pushing the support segment toward the center of each of said one or more sleeves.

17. The method of claim 12, further comprising the step of creating at least one fold in the sleeve template.

18. The method of claim 9, wherein the handle has four windows, and the beverage carrier comprises four sleeves.

19. The method of claim 9, wherein the handle has six windows, and the beverage carrier comprises six sleeves.

* * * * *